US010235909B2

(12) United States Patent
Detzer

(10) Patent No.: US 10,235,909 B2
(45) Date of Patent: Mar. 19, 2019

(54) SIGN ASSEMBLY

(71) Applicant: iDoor, LLC, Scottsdale, AZ (US)

(72) Inventor: Patricia Bear Detzer, Scottsdale, AZ (US)

(73) Assignee: iDoor, LLC, Scottsdale, AZ (US)

( * ) Notice: Subject to any disclaimer, the term of this patent is extended or adjusted under 35 U.S.C. 154(b) by 0 days.

(21) Appl. No.: 16/006,273

(22) Filed: Jun. 12, 2018

(65) Prior Publication Data

US 2018/0357939 A1 Dec. 13, 2018

Related U.S. Application Data

(60) Provisional application No. 62/518,946, filed on Jun. 13, 2017.

(51) Int. Cl.
*G09F 7/10* (2006.01)
*G09F 7/18* (2006.01)

(52) U.S. Cl.
CPC ..... *G09F 7/10* (2013.01); *G09F 7/18* (2013.01); *G09F 2007/1843* (2013.01)

(58) Field of Classification Search
CPC ..... G09F 7/10; G09F 7/18; G09F 2007/1843; A47G 1/162; A47G 1/166
See application file for complete search history.

(56) References Cited

U.S. PATENT DOCUMENTS 299,155 A * 5/1884 McGill ..... A47G 1/162 248/498
3,289,985 A * 12/1966 Sheiman ..... A45C 3/004 223/85
5,813,155 A * 9/1998 Shen ..... A47G 1/0622 248/126
6,351,904 B1 * 3/2002 Hermanson ..... G09F 13/02 40/559
6,609,693 B2 * 8/2003 Hui ..... A47F 5/0006 248/304
8,418,858 B2 * 4/2013 Foltz ..... F16M 13/02 211/113
8,746,647 B2 * 6/2014 Stewart, III ..... B62B 5/00 248/506
2003/0193005 A1 * 10/2003 Hui ..... A47F 5/0006 248/489
2007/0157500 A1 * 7/2007 Wolfe ..... G09F 7/10 40/781
2011/0314713 A1 * 12/2011 Massaad ..... G09F 7/18 40/593

* cited by examiner

*Primary Examiner* — Gary C Hoge
(74) *Attorney, Agent, or Firm* — Burch & Cracchiolo, P.A.

(57) ABSTRACT

A sign assembly having a frame, a sign and an attachment assembly. The frame has a front frame with an open portion for viewing a sign and a rear frame that has a back connected to parallel sides each of which has a notch. The rear frame and the front frame are connected to one another via the sides that define a slot between them. The sign has a body and an extended portion. Each notch engages the extended portion when the sign is inserted into the slot. The attachment assembly has a hanging member and is rotatably connected to the back of the rear frame.

15 Claims, 9 Drawing Sheets

SIGN ASSEMBLY

FIELD OF THE INVENTION

The present invention relates to a sign assembly and methods for making the same.

BACKGROUND OF THE INVENTION

Signs are ubiquitous and have been around for many years to convey information for a variety of purposes, such as street signage, advertising and warnings.

BRIEF SUMMARY OF THE INVENTION

One aspect of the present invention provides a sign assembly, comprising: a frame including a front frame defining an open portion, the open portion being configured to expose a sign, and a rear frame including a back member and substantially parallel sides each comprising a notch, the substantially parallel sides being connected to the back member, the sides of the rear frame being connected to the front frame defining a slot between the front frame and the rear frame; a sign, the sign comprising a body and an extended portion, the extended portion being configured to engage with the notch when the sign is inserted in the slot so it can be viewed through the open portion; and an attachment assembly, the attachment assembly comprising a hanging member and being rotatably attached to the back member of the rear frame.

BRIEF DESCRIPTION OF THE DRAWINGS

Illustrative and presently preferred exemplary embodiments of the invention are shown in the drawings in which.

DETAILED DESCRIPTION OF THE INVENTION

While signs have been around for a long time, new physical signs tend toward the electronic. Signs may even be virtual in which messages are conveyed using social media platforms. Physical signs remain bulky, inelegant and difficult to hang in a way that does not damage walls or doors. In addition, many existing signs do not come equipped with hardware or other hanging mechanisms. Moreover, physical signs for temporary purposes such as a birthday party or other event, are not very durable and can blow away in the wind or degrade in rain or snow. In contrast, the present invention solves these problems with the present sign assembly that is durable, customizable, easy to hang with the novel attachment assembly and presents a finished, professional appearance in contrast to a taped-up paper sign or a wooden sign hung with a driven nail, for example. The sign assembly of the present invention may be used to give directions and information to visitors or guests arriving at a home or business in a highly personalized manner.

Figure 1:
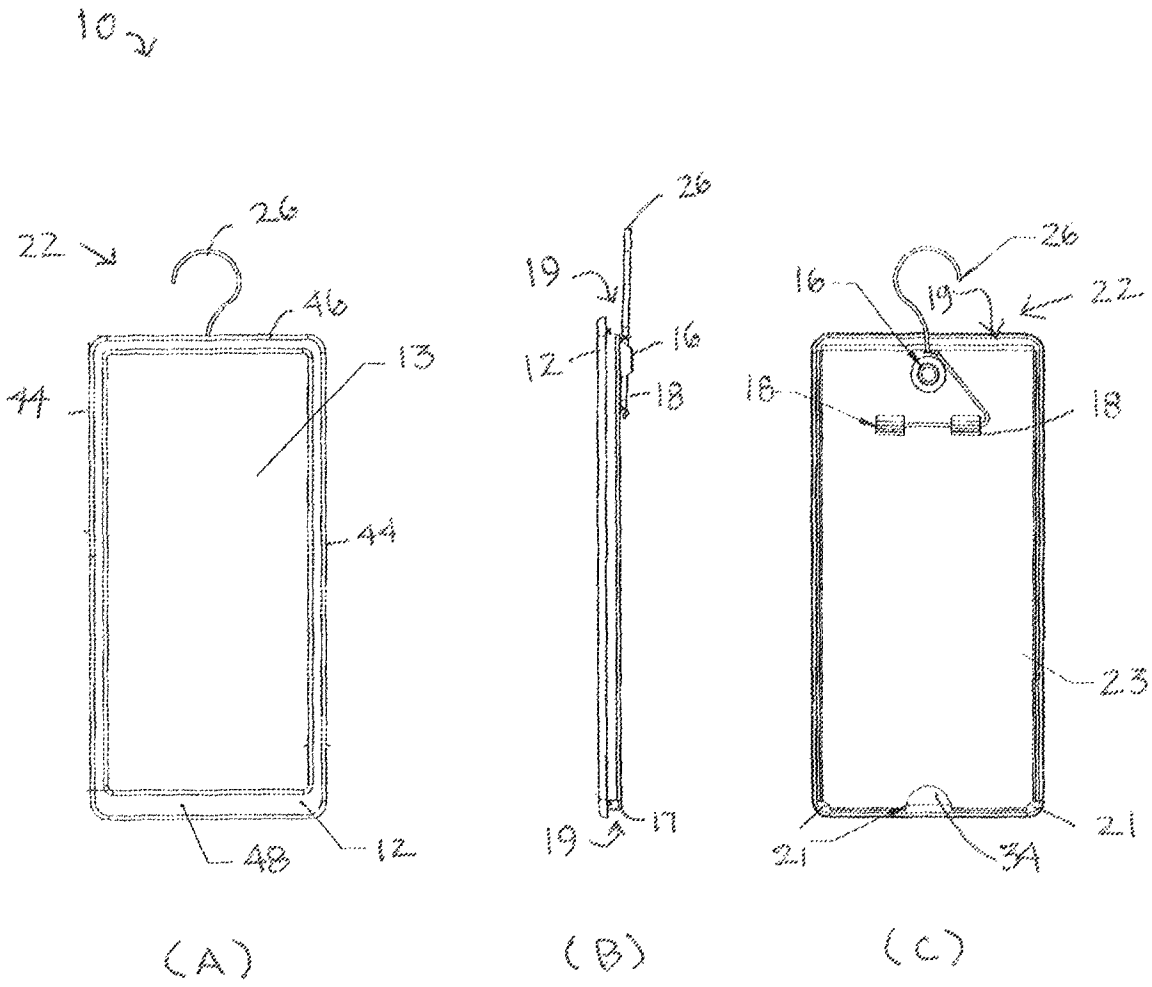
FIG. 1 shows multiple views of an embodiment of a sign assembly of the present invention in which view (A) shows a view of the front of a sign assembly, view (B) shows a side view of a sign assembly, and view (C) shows a rear view of a sign assembly.

Various embodiments of sign assembly 10 will now be explained with reference to the drawings. As shown in FIG. 1, the present invention for sign assembly 10 comprises frame 11, attachment assembly 22 and sign 34.

Figure 2:
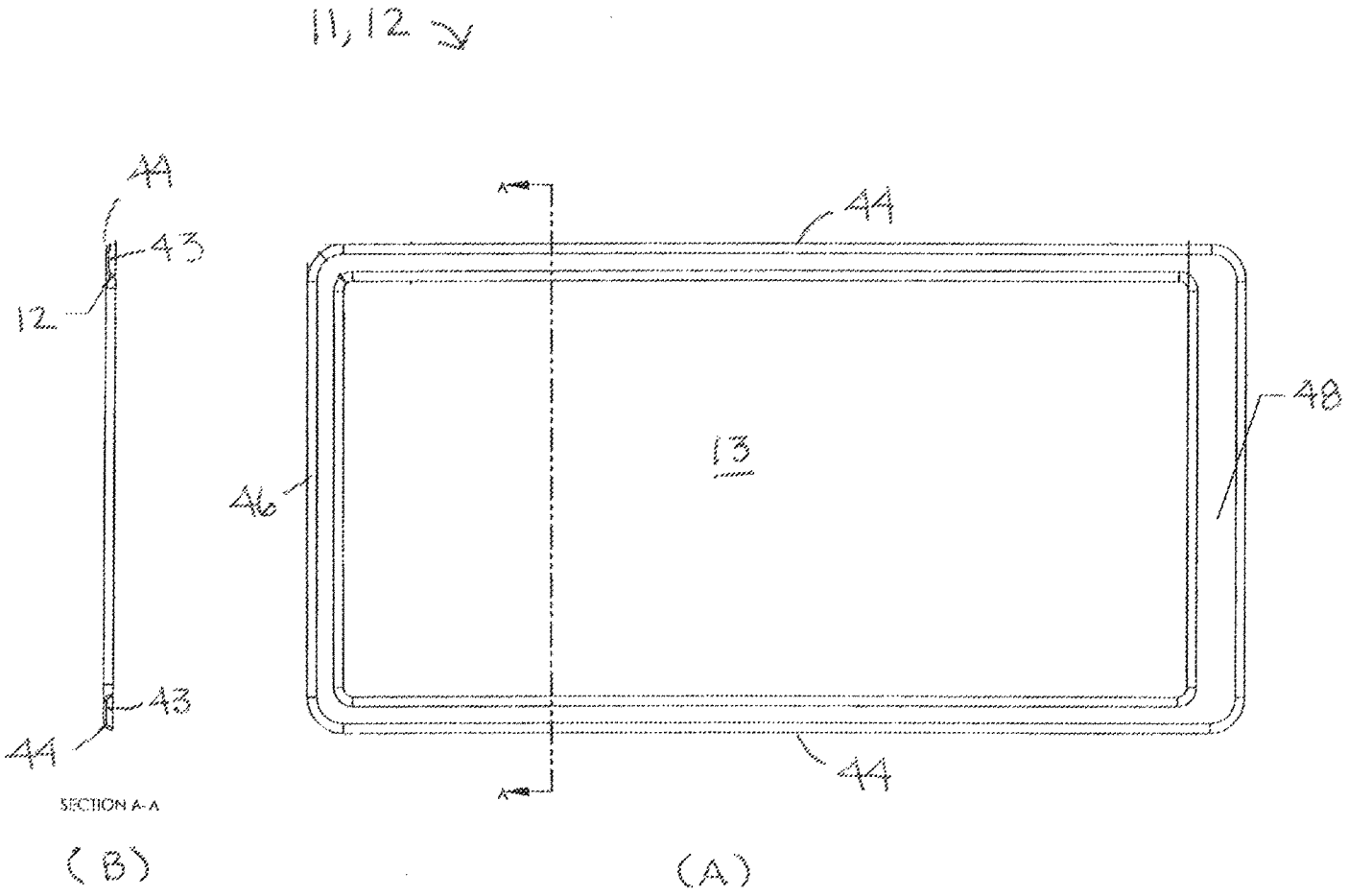
FIG. 2 shows multiple views of an embodiment of the front frame of the sign assembly of the present invention in which view (A) is a plan view of a front frame of and embodiment of the sign assembly of the present invention and view (B) is a cross section of a front frame of the sign assembly of the present invention taken through A-A' line of view (A)
Figure 3:
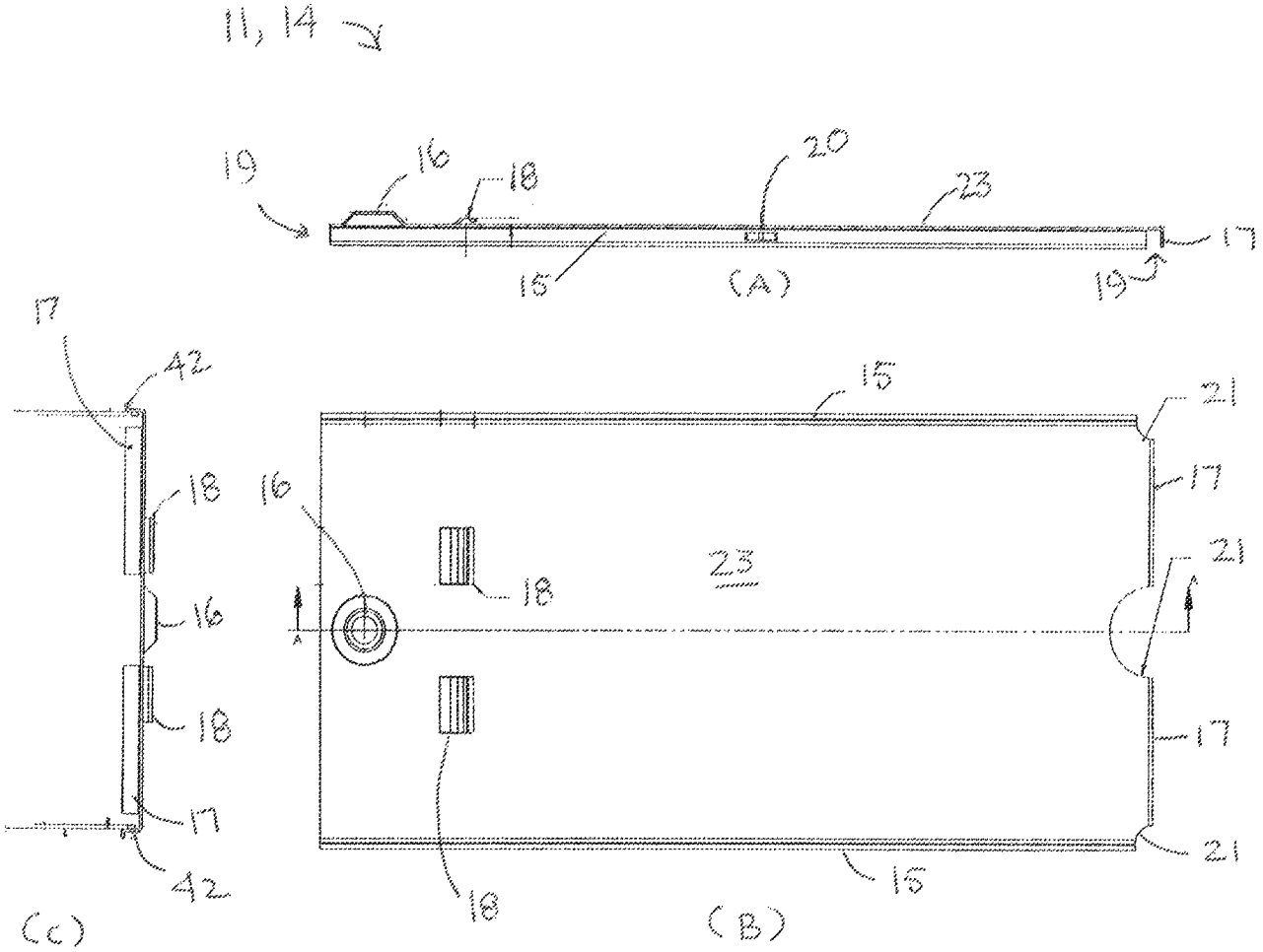
FIG. 3 shows multiple views of an embodiment of the rear frame of the sign assembly of the present invention in which view (A) is a cross section taken through A-A' line of view (B), view (B) is a plan view of a rear frame of an embodiment of the sign assembly of the present invention, and view (C) is a top view.
Figure 8:
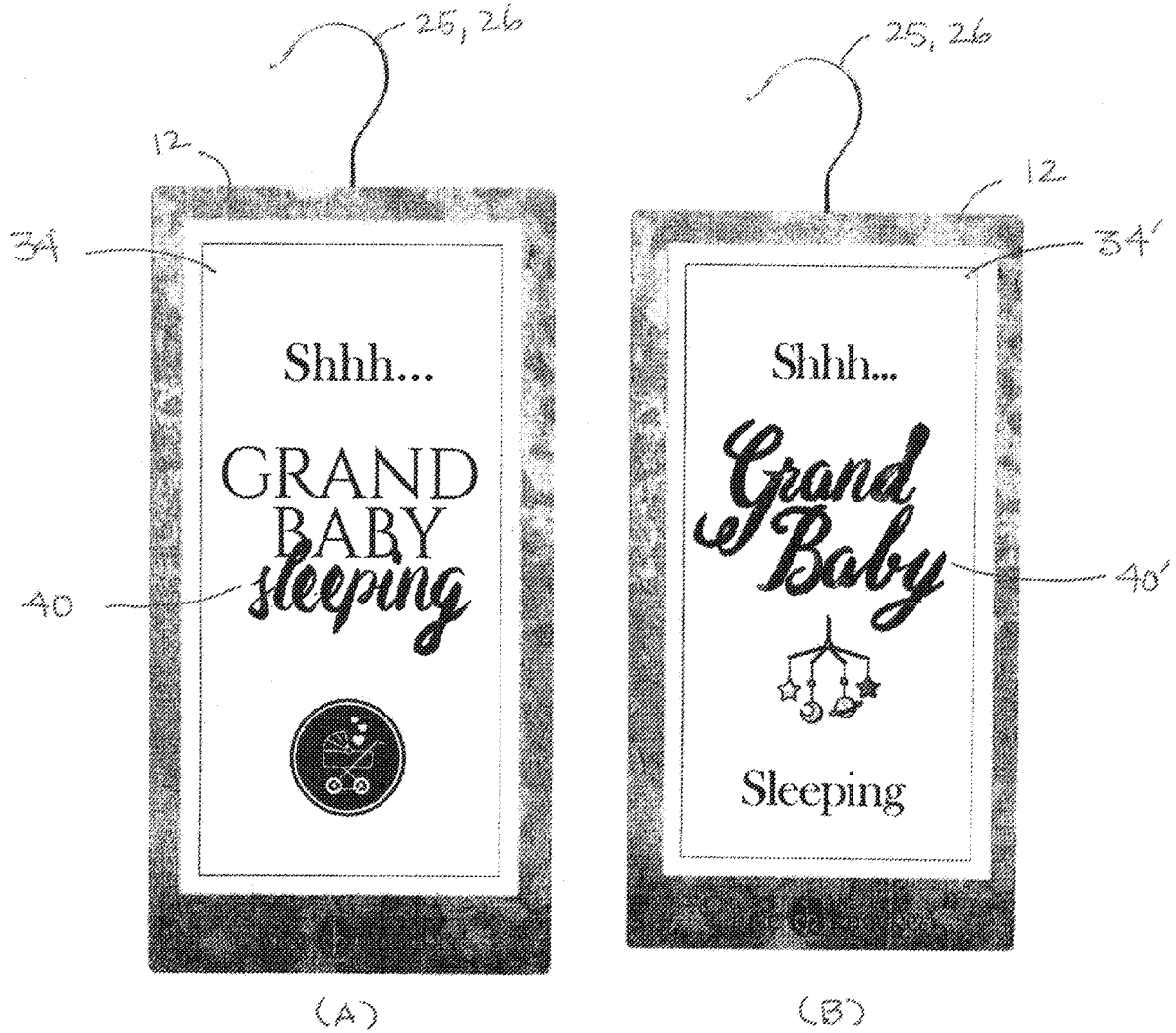
FIG. 8 shows multiple embodiments of the sign and sign assembly of the present invention in which view (A) shows an embodiment of a message and view (B) shows another embodiment of a message.

As shown in FIGS. 2 and 3, frame 11 comprises front frame 12 and rear frame 14. Front frame 12 comprises sides 44, top 46 and bottom 48. In an embodiment shown, sides 44 are substantially parallel to one another and each side is connected to top 46 and bottom 48 to form a rectangular shape, defining open portion 13 in between. In embodiments, open portion 13 may be open or be secured with a clear covering through which sign 34 (and message 40, 40') may be viewed. FIGS. 1, 2 and 8. Although frame 11, including front frame 12 and rear frame 14, are described herein as being substantially rectangular in shape, the present invention should not be viewed as being limited in this respect. Any geometrical shape or even a free-form shape may be used, as would be familiar to one of ordinary skill in the art after becoming familiar with the teachings of the present invention.

Figure 4:
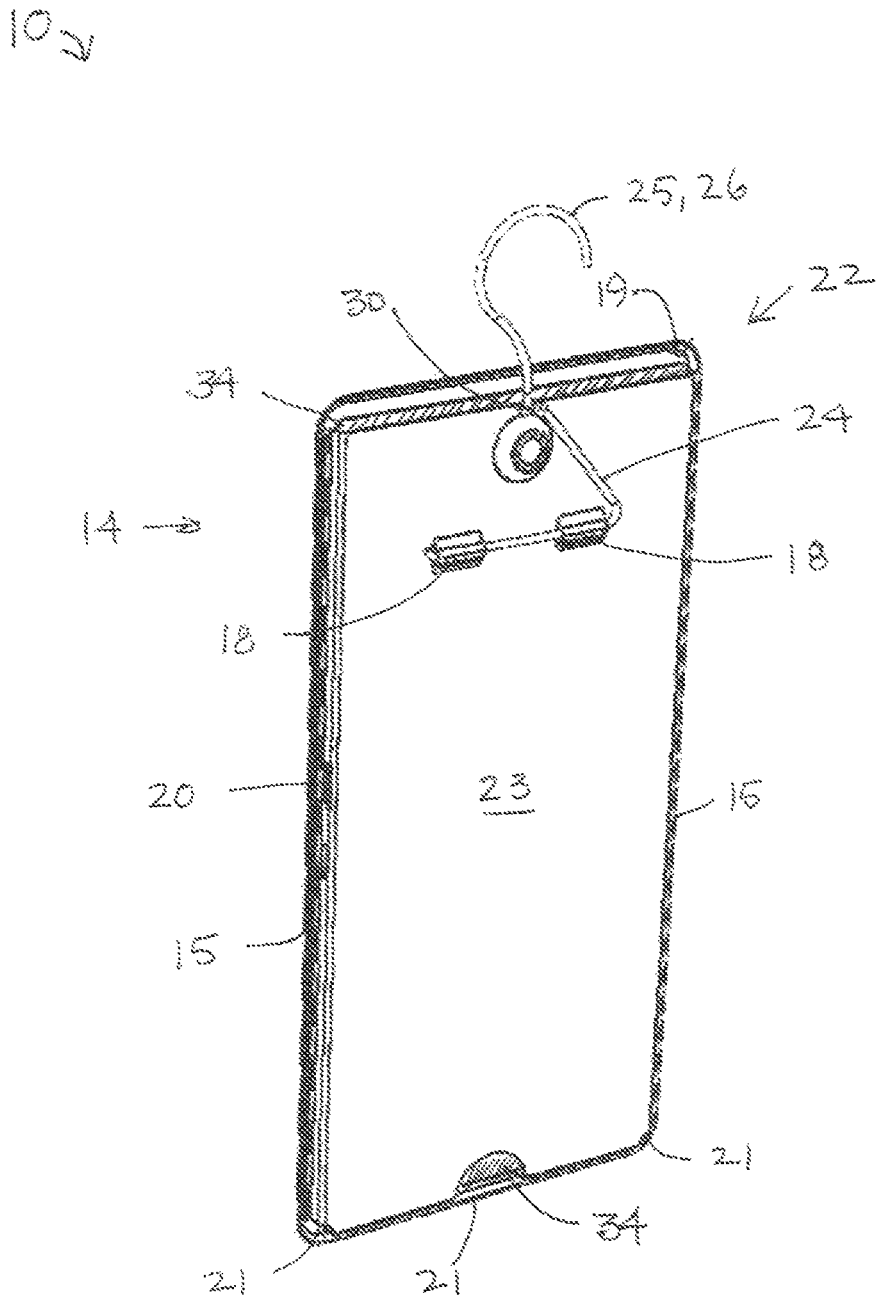
FIG. 4 shows an embodiment of the rear frame, sign, and attachment assembly of the present invention.

An embodiment of rear frame 14 is shown in FIGS. 3 and 4. In an embodiment shown primarily in FIG. 3, rear frame 14 comprises sides 15, substantially solid back 23, bottom 17, recess(es) 21 and notch 20, as well as hook relief 16 and hinge(s) 18, which function as part of attachment assembly 22. See FIG. 4. As in the case of front frame 12, in rear frame 14, sides 15 are substantially parallel to one another and each side 15 is connected in perpendicular fashion to back 23. Each side is also connected to bottom 17 to form a general U or channel shape. Bottom 17 is attached to back 23 in perpendicular fashion to form a shelf.

As shown in plan view FIG. 3(*c*), a cross-section of rear frame 14 is generally U-shaped with lip 42 attached to side 15. Frame 11 of sign assembly 10 is formed when rear frame 14 is attached to front frame 12, defining open slot 19 for receiving sign 34. Specifically, lip 42 is attached to sides 44 of front frame 12 and bottom 17 of rear frame 14 is attached to bottom 48 of front frame 12, forming frame 11 defining open slot 19 for receiving sign 34 in between front frame 12 and rear frame 14. Acting as a shelf, bottom 17 retains sign 34 in the sign assembly 10 so sign 34 does not slip through frame 11.

In an embodiment shown in FIGS. 3 and 4, recesses 21 may be provided in back 23 of rear frame 14 for ease in ejecting sign 34 from sign assembly 10; however, this is not required. In the embodiment shown, notch 20 is formed out of each of sides 15. Notch 20 extends extending inward, for engaging with extended portion 38, 38' of sign 34, as will be explained in more detail below.

In one embodiment, frame 11 may be made of plastic, such as by plastic injection molding. Front frame 12 and rear frame 14 may be made of multiple pieces or may be a singular integrated frame 11, as would be familiar to one of ordinary skill in the art after becoming familiar with the teachings of the present invention. In addition, other suitable materials may be used for making frame 11, comprising front frame 12 and rear frame 14, such as metal, composite materials or wood. Thus, the manner in which front frame 12 and rear frame 14 are attached to one another may be a function of the material used to make them. Depending of the material, front frame 12 and rear frame 14 may be glued or soldered together or otherwise attached using suitable fasteners such as clips, as would be familiar to one of ordinary skill in the art after becoming familiar with the teachings of the present invention.

Figure 5:
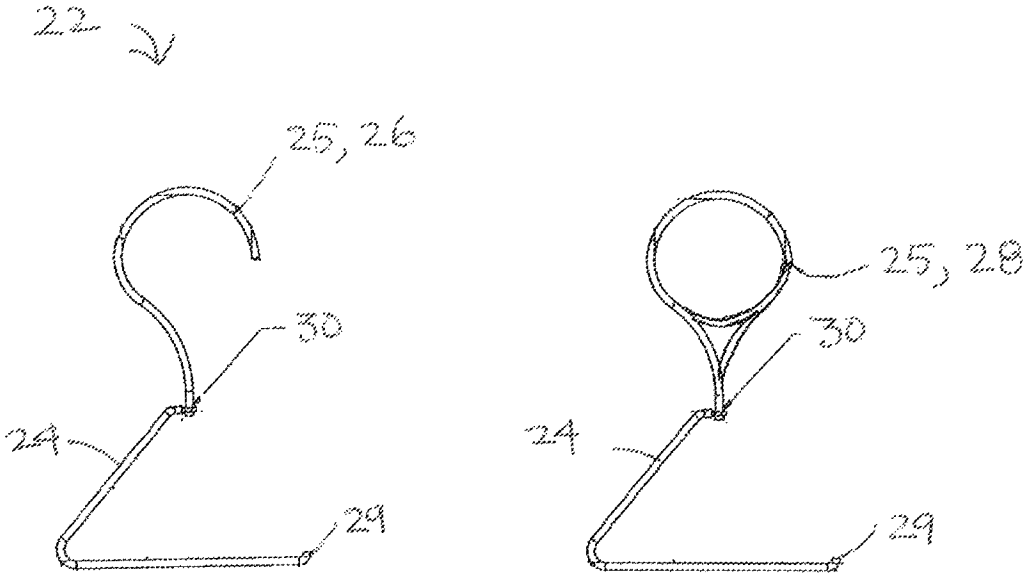
FIG. 5 shows multiple embodiments of the attachment assembly of an embodiment the present invention in which view (A) shows a hook and view (B) shows a ring.
Figure 6:
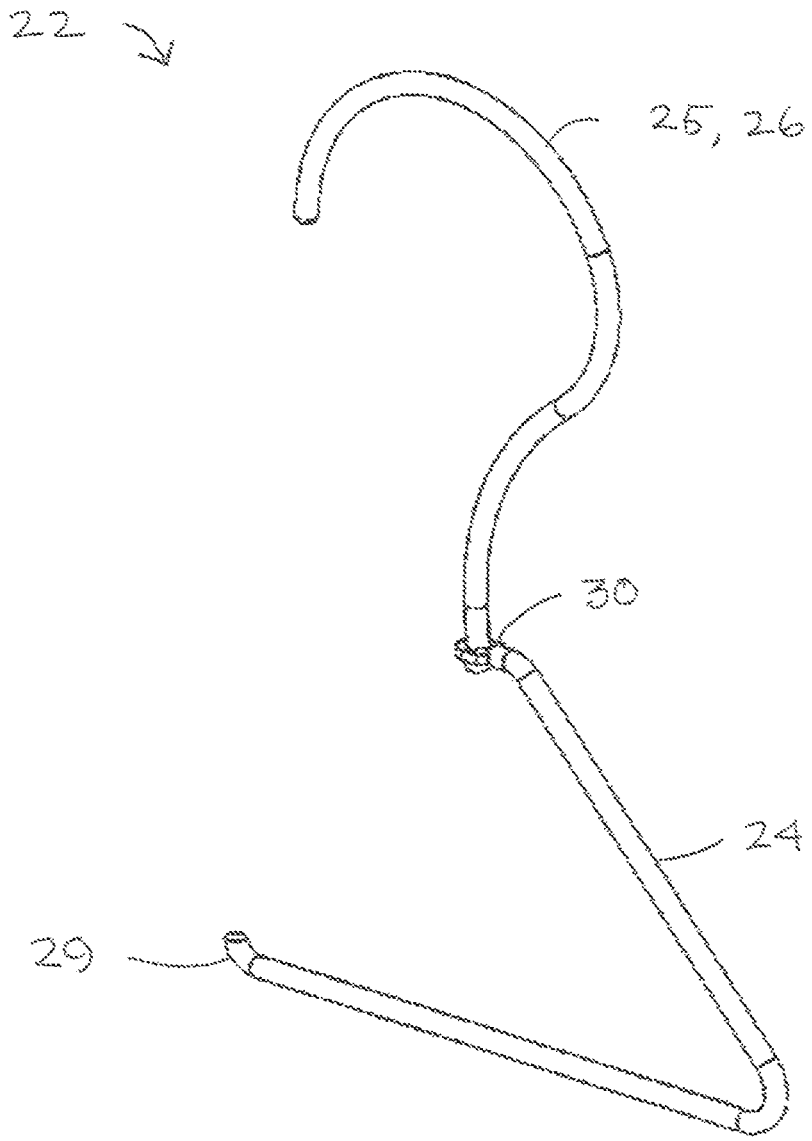
FIG. 6 shows an embodiment of the attachment assembly of an embodiment the present invention.

Attachment assembly 22 will now be described with reference to FIGS. 4-6. Attachment assembly 22 is used to hang sign assembly 10 from a wall, door or protrusion (e.g., nail, hook) so that it can be seen. Attachment assembly 22 comprises base wire 24 and hanging member 25, as well as hinge(s) 18. As shown in FIGS. 4, 5(A) and 6, hanging member 25 comprises hook 26; however, as shown in FIG. 5(B), hanging member 25 may also comprise ring 28. Thus, hanging member 25 may comprise any suitable shape for hanging sign assembly and may be made out of any suitable material, including wire or soft wire that may be bendable.

Hook relief 16 comprises another means for hanging sign assembly 10. In another embodiment, hook relief 16 may be used to hang sign assembly 10 from a protrusion on a surface (i.e., nail or hook on a wall or door, etc.) when attachment assembly 22 is folded against back 23.

In embodiments shown in FIGS. 5 and 6, hanging member 25 (e.g., hook 26) is rotatably attached to one end of base wire 24 (e.g., hook 26) using swivel connector 30 or other appropriate connector that allows hook 26 to rotate freely so that the orientation of hook 26 may changed. Base wire 24 is configured to be received by hinge(s) 18 mounted on a substrate, namely, in an embodiment, back 23 of rear frame 14 so that attachment assembly 22 can be connected to and operatively associated with frame 11. As shown in FIGS. 5 and 6, base wire 24 comprises two connected sides of an approximate triangle with stop 29 connected to the open end of base wire 24. Stop 29 is configured to allow base wire 24 to be inserted in hinge 18, while hindering base wire 24 from slipping out of hinge 18. The invention should not be viewed as being limited to a base wire 24 of any specific shape or configuration. Base wire 24 can be of any shape that may be received by hinges(s) 18.

In an embodiment shown, base wire 24 is configured not only to be received by hinge(s) 18, but also to avoid compromising hook relief 16. As a result, both attachment assembly 22 and hook relief 16 are available to be used to hang sign assembly 10.

Hinge(s) 18 may comprise a single hinge or multiple hinges. Hinge(s) 18 connects attachment assembly 22 to frame 11. In addition, hinge(s) 15 allow attachment assembly 22 to move in relation to the substrate (e.g, back 23) to accommodate a variety of hangers (e.g., on a door, lamp post, light, etc.). Hinge(s) 18 also allow attachment assembly 22 to be folded against back 23 for storage, shipping or using hook relief 16 to hang sign assembly 10.

Attachment assembly 22 may be used in applications other than sign assembly 10. By way of example, hinge 18 may be connected to any substrate and attachment assembly 22 could then be used to hang whatever is attached to the substrate, such as artwork, bas relief, a clock, a display, a television, a monitor, and the like, as would be familiar to one of ordinary skill in the art after becoming familiar with the teachings of the present invention.

Figure 7:
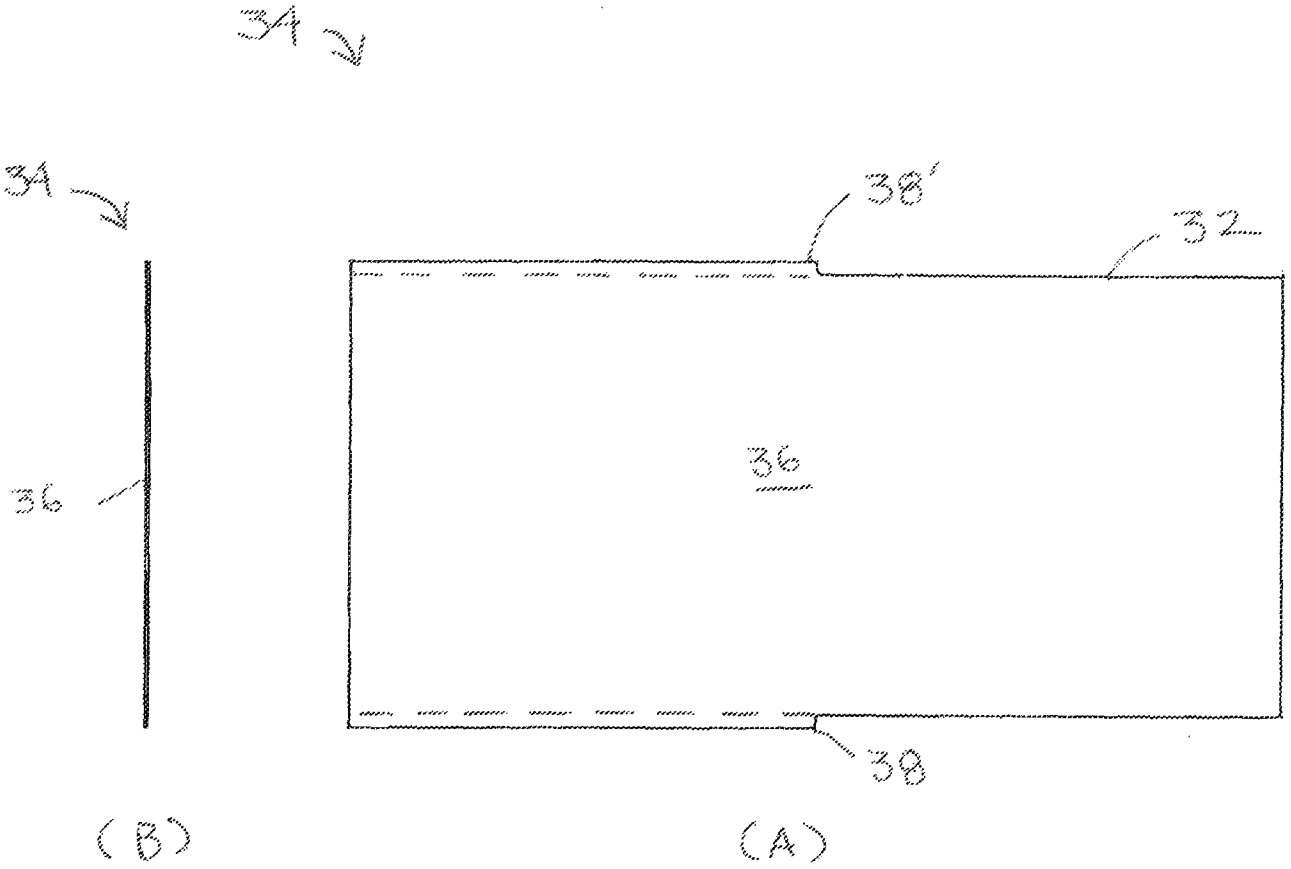
FIG. 7 shows an embodiment of a sign of the present invention in which view (A) is a plan view and view (B) is a side view.
Figure 9:
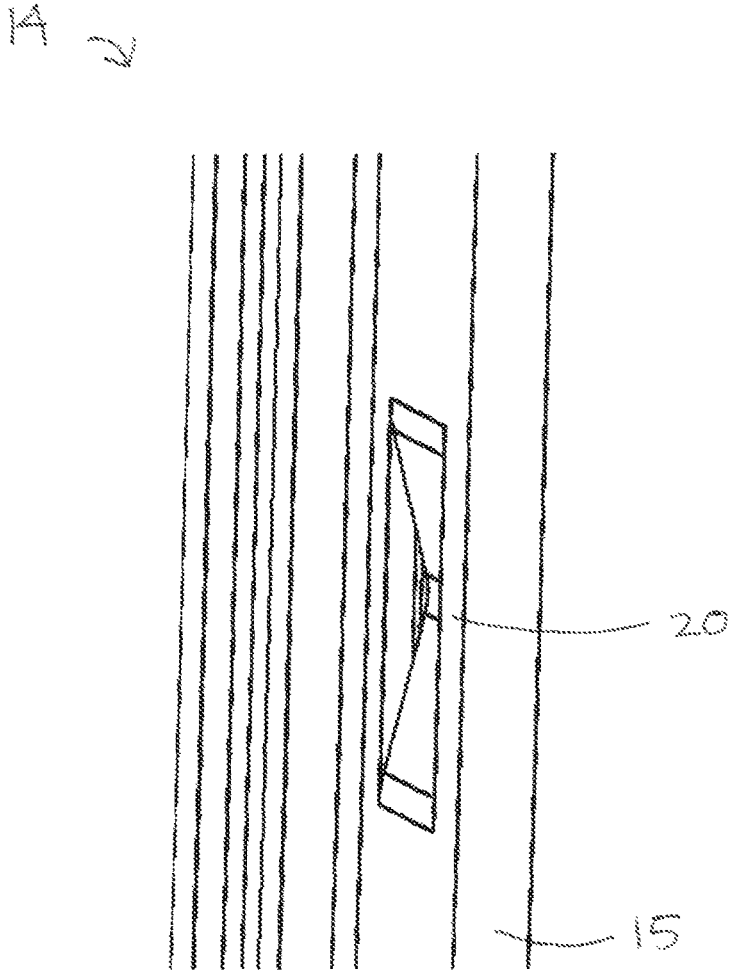
FIG. 9 shows a detail of an embodiment of a notch in a side of the rear frame of the present invention.

Sign 34 will now be described with reference to FIGS. 7-9. In an embodiment shown in FIG. 7, sign 34 comprises sign body 36 and extended portion 38, 38'. In an embodiment shown in FIG. 7, extended portion 38, 38' abuts and is attached to opposite sides of sign body; in the embodiment shown, extended portion 38, 38' is integral with body 36. Extended portion 38, 38' is configured to engage notch 20 of sides 15 of rear frame 14 to keep sign 34 in place, as is explained in more detail below. Sign 34, 34' may be made of paper, laminated paper, plastic, vinyl, metal or any other suitable material on which message 40, 40', may be printed or attached. Examples of messages 40, 40' in various embodiments are shown in FIG. 8.

Method(s) for making and using sign assembly 10 will now be described. As described above, front frame 12 and rear frame 14 are made and attached to one another to make frame 11, leaving open slot 19 defined between front frame 12 and rear frame 14.

Attachment assembly 22 is then connected to hinge(s) 18 installed on back 23 of rear frame 14. Base wire 24 is inserted into hinge(s) 18, beginning with stop 29. Once base wire 24 has been inserted into hinge(s) 18, stop 29 hinders base wire 24 from sliding out of or otherwise being dislodged from hinge(s) 18.

Sign 34, 34' is fashioned with message 40, 40' that may be customized. When message 40 is selected, sign 34 bearing the selected message 40 is slid into open slot 19 so that message 40 can be viewed through open portion 13 of front frame 12. Extended portion(s) 38 of sign 34 remain toward the open top of frame 11. This allows the narrow portion 32 of sign body 36 to slide past notch(es) 20 which extend inward from sides 15 of rear frame 14. The extended portion(s) 38, 38' catch on notch(es) 20, holding sign 34 firmly in place.

With sign 34 firmly in place, sign assembly 10 may then be hung either by using attachment assembly 22 or hook relief 16. When using attachment assembly 22, hanging member 25 may be folded into an upright position by rotating base wire 24 in hinge(s) 18. Aided by swivel connector 30, hanging member 25 may be turned rotatably to be received by the selected protrusion from which the user wishes to hang sign assembly 10. Since hanging member 25 rotates in relation to base wire 24 and base wire 24 rotates in relation to back 23 via hinge(s) 18, sign assembly 10 will appear substantially straight and plumb when hung.

In an alternative embodiment, hanging member 25 may be folded substantially flat against back 23 using swivel connector 30 and base wire in hinge(s) 18. In that case hook relief 16 may be used to hang sign assembly 10 from a nail, for example.

When the user decides to change sign 34 and message 40, the user may then slide sign 34 out of open slot 19, so that a new sign 34' with message 40' may be inserted instead.

When a user desires to change signs 34, the user can easily eject sign 34 by pushing sign 34 toward the open top of frame 11 out of open slot 19 using recess(es) 21 in back 23. In an embodiment, recesses 21 in back 23 may be used to push narrow portion 32 of sign body 36 until extended portion 38, 38' is pushed free of notch 20 of sides 15 so that sign 34 can be pulled from open slot 19. The process is then repeated to insert new sign 34' with new message 40'.

In understanding the scope of the present invention, the term "comprising" and its derivatives, as used herein, are intended to be open ended terms that specify the presence of the stated features, elements, components, groups, and/or steps, but do not exclude the presence of other unstated features, elements, components, groups, and/or steps. The foregoing also applies to words having similar meanings such as the terms, "including," "having" and their derivatives. Any terms of degree such as "substantially," "about" and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adapted to another embodiment. It should be noted that while the present invention is shown and described herein as it could be used in conjunction with a configuration of various components, it could be utilized with other configurations, either now known in the art or that may be developed in the future, so long as the objects and features of the invention are achieved, as would become apparent to persons having ordinary skill in the art after having become familiar with the teachings provided herein. Consequently, the present invention should not be regarded as limited to that shown and described herein. It is not necessary for all advantages to be present in a particular embodiment at the same time. Thus, the foregoing descriptions of the embodiments according to the present invention are provided for illustration only, and not for the purpose of limiting the invention as defined by the appended claims and their equivalents.

Having herein set forth preferred embodiments of the present invention, it is anticipated that suitable modifications can be made thereto which will nonetheless remain within the scope of the invention, including all changes that come within the meaning and range of equivalents. The invention shall therefore only be construed in accordance with the following claims:

What is claimed is:

1. A sign assembly, comprising:

a frame, comprising:

a front frame defining an open portion, the open portion being configured to expose a sign, and a rear frame comprising a back member and substantially parallel sides each comprising a notch, the substantially parallel sides being connected to the back member, the sides of the rear frame being connected to the front frame defining a slot between the front frame and the rear frame;

a sign, the sign comprising a body and an extended portion, the extended portion being configured to engage with the notch when the sign is inserted in the slot so it can be viewed through the open portion;

an attachment assembly, the attachment assembly comprising a hanging member and being rotatably attached to the back member of the rear frame.

2. The sign assembly of claim 1, wherein the hanging member comprises a hook.

3. The sign assembly of claim 1, wherein the back member comprises a hook relief.

4. The sign assembly of claim 1, further comprising at least one hinge connected to the back member and wherein the attachment assembly comprises a base wire and a swivel connector, the base wire being configured to be received by the hinge and connected at one end to the swivel connector, the swivel connector being rotatably connected to the hanging member.

5. The sign assembly of claim 4, wherein the base wire comprises a stop, the stop being configured to retain the base wire in the at least one hinge.

6. The sign assembly of claim 4, further comprising a hook relief and wherein the base wire is configured to fold the attachment assembly against the back member to avoid the hook relief.

7. An attachment assembly, comprising:

a hinge mounted to a substrate;

a hanging member, the hanging member being a hook;

a base wire having a first end and a second end, the first end of the base wire being rotatably connected to the hanging member and the second end of the base wire being configured to be received by the hinge, the base wire received by the hinge being configured to rotate with respect to the substrate.

8. The attachment assembly of claim 7, further comprising a swivel connector and wherein the first end of the base wire is connected to the swivel connector which is connected to the hanging member.

9. The attachment assembly of claim 7, wherein in the substrate comprises the back of a sign.

10. The attachment assembly of claim 7, further comprising a stop, the stop being attached to the second end of the base wire and configured to be received by and retained within the hinge.

11. A sign assembly, comprising:

a frame, comprising a front frame and a rear frame, the front frame defining an open portion configured to expose at least a first sign, the rear frame comprising a back member, a bottom and substantially parallel sides connected to the back and bottom in perpendicular fashion, the sides each comprising a notch and being connected to the front frame defining a slot between the front frame and the rear frame, the slot being closed at one end by the bottom;

a sign, the sign comprising a body and substantially parallel extended portions on opposite sides of the body, the extended portions being configured to engage with each notch when the sign is inserted in the slot so the sign can be viewed through the open portion; and an attachment assembly, the attachment assembly comprising a hanging member and a base wire, the hanging member being rotatably attached to a first end of the base wire, the base wire being rotatably attached to the back member by at least one hinge.

12. The sign assembly of claim 11, wherein the base wire being rotatably attached to the back member comprises the base wire being inserted in the hinge and wherein the base wire comprises a stop attached to a second end of the base wire, the stop being configured to retain the base wire in the hinge.

13. The sign assembly of claim 12, wherein the back member comprises a hook relief and wherein the base wire being rotatably attached to the back member by at least one hinge is configured to fold the attachment assembly against the back member to avoid the hook relief.

14. The sign assembly of claim 11, wherein the back member comprises at least one recessed portion.

15. The sign assembly of claim 11, wherein the attachment assembly comprises a swivel connector, the swivel connector being configured to rotatably attach the hanging member to the first end of the base wire.

* * * * *